US006022026A

United States Patent [19]

Johnson, III

[11] Patent Number: 6,022,026

[45] Date of Patent: Feb. 8, 2000

[54] METHOD OF PLAYING A STACKING BLOCK GAME AND GAME BLOCKS THEREFOR

[75] Inventor: Walter Johnson, III, North Andover, Mass.

[73] Assignee: Irwin Toy Limited, Toronto, Canada

[21] Appl. No.: 09/288,487

[22] Filed: Apr. 8, 1999

Related U.S. Application Data

[62] Division of application No. 08/789,190, Jan. 24, 1997, abandoned

[60] Provisional application No. 60/010,654, Jan. 26, 1996.

[51] Int. Cl.[7] ..... A63F 9/00

[52] U.S. Cl. ..... 273/450; 273/449; 273/290; 273/288; 273/293; 273/160

[58] Field of Search ..... 273/449, 450, 273/290, 288, 293, 143 A, 160

[56] References Cited

U.S. PATENT DOCUMENTS

| | | | |
|---|---|---|---|
| 1,749,653 | 3/1930 | Winter | 273/309 |
| 3,827,695 | 8/1974 | Hess | 273/450 |
| 4,215,858 | 8/1980 | Olsen | 273/449 |
| 4,522,393 | 6/1985 | Dunn | 273/450 |
| 4,852,878 | 8/1989 | Merrill | 273/156 |
| 5,611,544 | 3/1997 | Grebler et al. | 273/447 |

FOREIGN PATENT DOCUMENTS

| | | | |
|---|---|---|---|
| 0 190 876 | 8/1986 | European Pat. Off. | 273/449 |
| 0 247 515 | 2/1987 | European Pat. Off. . | |
| 623107 | 5/1949 | United Kingdom . | |
| 2 130 105 | 5/1984 | United Kingdom . | |
| 2185691 | 7/1987 | United Kingdom | 273/449 |
| 2307867 | 11/1997 | United Kingdom | 273/449 |

OTHER PUBLICATIONS

"Uno Stacko", Mattel, 1995.

*Primary Examiner*—Benjamin H. Layno
*Attorney, Agent, or Firm*—Vidas Arrett & Steinkraus, P.A.

[57] ABSTRACT

A method of playing a stacking block game is disclosed. The game uses a plurality of game blocks have a generally parallelepiped shape aid generally similar dimensions. Each game block has indicia applied to at least one end thereof. The indicia include a suit and a rank. Each player receives a number of game blocks. The first player lays a first game block on its face or on its side on a playing surface. The next player has to lay a game block of the same suit or rank as the first game block on top of or optionally on the same level as the previously laid game block to thereby build a tower.

8 Claims, 1 Drawing Sheet

METHOD OF PLAYING A STACKING BLOCK GAME AND GAME BLOCKS THEREFOR

This application is a divisional of Application No. 08/789,190 files Jan. 24, 1997, abandoned, claiming priority to Provisional of application Ser. No. 60/010,654 Jan 26, 1996, the entire contents of which are hereby incorporated by reference.

FIELD OF INVENTION

This invention relates to a game which is played rising game blocks and the games blocks therefor. In particular, this invention relates to a novel three dimensional game which uses game blocks having indicia on each end thereof.

BACKGROUND OF INVENTION

Wooden blocks are well known in the art. Various indicia added to the faces of the blocks provide additional educational and entertainment value when the blocks are played with.

Recently, wooden blocks having a generally parallelepiped shape have been used in a stacking game. The game is commercially known under the trademark JENGA. In this game, the blank wooden blocks are stacked three per row in an alternating pattern. The blocks are not necessarily of uniform thickness. In turn, each player removes a block, and stacks it on top. The player who causes the tower to topple is the loser.

Even more recently, an improved game using similar blocks has been developed. This game is known commercially as JENGA ULTIMATE. This game is played in a similar manner to JENGA, except that the blocks are coloured in one of a number of colors. A player rolls a die to select a color of block to remove. Limiting the number of blocks that can be removed increases the skill level required to be successful in the game.

The prior art games have been commercially successful. However, the number of games which can be played is limited.

SUMMARY OF INVENTION

The present invention contemplates a plurality of game blocks having a generally parallelepiped shape and having indicia applied to the ends of each game block.

According to one aspect of the invention, there is provided a plurality of game blocks having a generally parallelepiped shape and having generally similar dimensions. Each game block has indicia applied to the ends thereof.

According to another aspect of the invention, there is provided a plurality of game blocks, each having, on ends thereof, indicia which comprise a suit and a rank.

According to one aspect of the invention, there is provided a game comprising a plurality of game blocks. The game blocks have a generally elongate parallelepiped shape and each of the game blocks have, on ends thereof, indicia.

According to another aspect of the invention, a plurality of game block each has indicia comprising a suit character selected from the group of heart, spade, diamonds and clubs and an alphanumeric character for defining a rank selected from the group comprising 1, 2, 3, 4, 5, 6, 7, 8, 9, 10, J, Q, K, A.

According to yet another aspect of the invention, there is provided a game wherein each player receives a number of game blocks, whereupon a first player places a game block on its face or its side, but not on its end, and each player in turn places a game block, which must be of the same suit or rank as the previously played game block, on its face or on its side, but not on its end, to form a tower of perpendicular layers comprising one or more game blocks in each layer, and if a player cannot follow suit or rank, the player draws game blocks until a suitable game block can be played. If any player topples all or part of the tower, such player must gather and keep the game blocks so toppled for subsequent play, Play continues until a player runs out of game blocks.

DESCRIPTION OF THE DRAWINGS

In the drawings which illustrate embodiments of the present invention.

DESCRIPTION OF THE INVENTION

Figure 1:
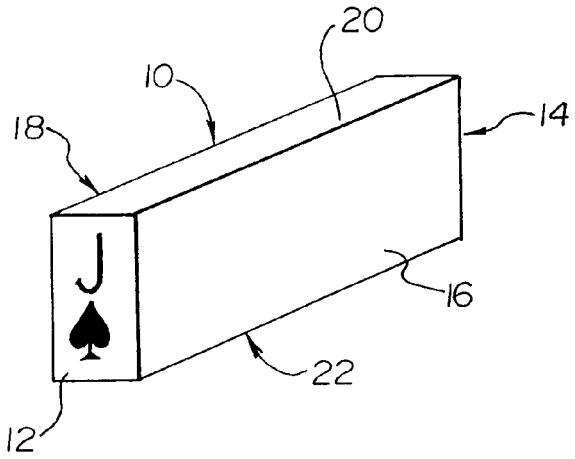
FIG. 1 is a perspective view of a game block of tie present invention.
Figure 2:
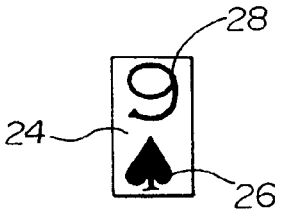
FIG. 2 is a plan view of a sticker for application to ends of a game block of the present invention.
Figure 3:
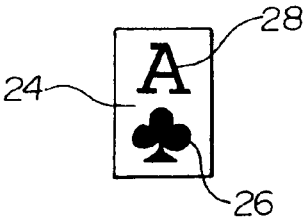
FIG. 3 is a plan view of a further sticker for application to ends of the game block of the present invention.
Figure 4:
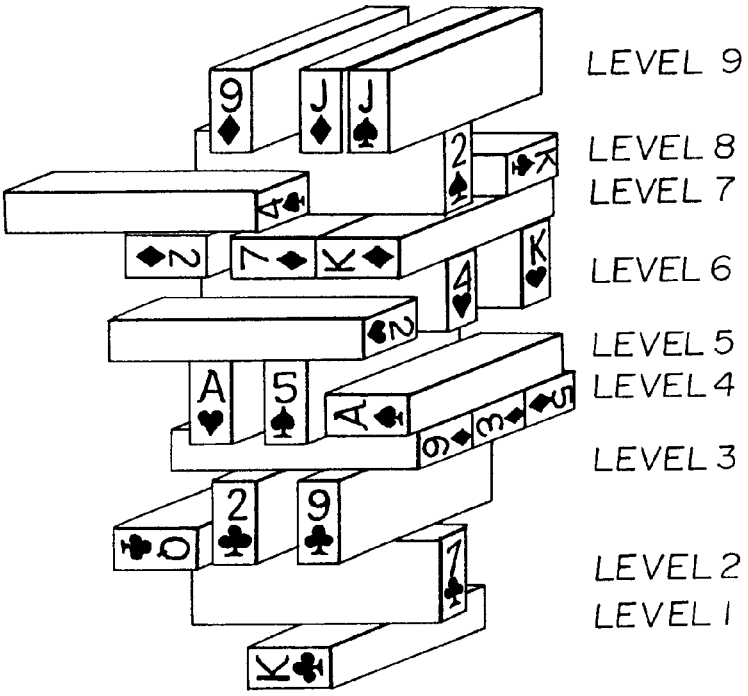
FIG. 4 is a perspective view of the game blocks of the present invention in a stacked condition.

Referring to FIG. 1, one game block 10 of the present invention is illustrated. Each game block has a generally elongate parallelepiped shape having a length, width and thickness. The length is greater than the width, which is preferably greater than the thickness. The game blocks have ends 12 and 14, faces 16 and 18 and sides 20 and 22.

Each end 12 and 14 has indicia applied thereto. In the preferred embodiment, the indicia is imprinted on self-adhesive paper 24, cut to size to fit on the ends 12 and 14 of each game block 10 and then applied thereto. Alternatively, the indicia could be engraved or stamped onto the ends 12 and 14.

In the preferred embodiment, the indicia comprise a suit character 26 selected from the group of heart, spade, diamonds and clubs and an alphanumeric character 28 selected from the group comprising 1, 2, 3, 4, 5, 6, 7, 8, 9, 10, J, Q, K, A. In addition, other game blocks may include "wild card" indicia. In the preferred embodiment, the indicia will represent each card of a standard deck of playing cards. It will be apparent to those skilled in the art that other combinations of suit characters and alphanumeric characters are possible and within the scope of this invention.

Between 2 to 6 players can play a game with the wooden game blocks of the present invention. Game blocks are drawn to determine the first player. The highest ranking card goes first. If wild cards are being used and one is selected for purposes of play start, it must be ignored or must be returned and another game block selected.

A number of game blocks are randomly distributed to each player. The first player places the first game block on its face or on its side, but not its end. The next player has to lay a game block of the same suit or rank as the first game block on top of or optionally on the same level as, the previous game block to thereby build a tower.

If the next player cannot follow suit or rank, that player must either draw additional game blocks until one can be played, draw game blocks from another player's hand until one can be played, or remove a playable game block from the tower from any level, except the top level.

Subsequent players must also follow suit or rank. Play continues until a player runs out of game blocks who is then declared to be the winner.

If a player topples all or part of the tower, the player must gather and keep the toppled game blocks for subsequent play.

Optionally, players can include wild game blocks and may select other card values as wild. For instance, a player could select J's as wild and therefore play the J's at any time. On introducing the wild J into play, the player may then select the following suit. Wild game blocks may be played in the same manner with the option of changing the direction of play.

In the preferred embodiment, each player should also comply with the following set of rules:

1. The first two levels of the tower comprise one or more game blocks each.
2. Any game block may be placed either on its side or on its face, but not on its end.
3. A game block must be perpendicular to the game blocks on the level immediately below.
4. After the second level, three game blocks comprise a level.
5. Game blocks on the same level must be parallel.
6. Game blocks on the same level need not line up or touch.
7. When starting a new level, the player must build on the highest game block.
8. A player must use only one hand at a time to stack a game block.
9. A player may touch a game block in the tower to determine if it is loose. If a game block is inadvertently moved out of place, it must be replaced before another game block may be touched.

The game blocks may be sold as a kit which could include trays for holding each player's game blocks and a bag for storing the game blocks.

It is apparent that both the traditional JENGA game and the improved JENGA ULTIMATE may be played with the game blocks of the present invention. For JENGA, the end indicia are ignored and the game is played in the traditional manner. For JENGA ULTIMATE, the alphanumeric indicia are ignored and the game played by selecting the suit of the game blocks to be removed.

Further, games played with die game blocks can be based on any card games which involve discarding cards to a central stack and have as their object the discarding of all the cards in a player's hand. This includes all rummy games, including gin rummy, rummy 500, rummy tile and Swedish rummy, alternately known as Crazy Eights or Crazy Jacks.

For instance, a three-dimensional variation of the game of rummy could be played. In such a game, each player receives a number of game blocks which are hidden from other player' view under a game block cover and one game block is placed at the center of play. A first player draws a game block either from an unused stock or table, arranges the hand in melds and then discards a game block of choice by stacking it to form a tower. The next player does the same, forming a tower. If any player topples all or part of the discard tower, such player must gather and keep the game blocks so toppled for subsequent play. Play continues until a player has melded all game blocks in the player's hand.

Although the disclosure describes and illustrates preferred embodiments of the invention, it is to be understood that the invention is nor limited to these particular embodiments. Many variations and modifications will now occur to those skilled in the art. For a definition of the invention, reference is to be made to the appended claims.

I claim:

1. A method of playing a game comprising the steps of:

distributing a game portion of stackable game pieces to each player of said game, each said game piece including indicia comprising a first symbol from a first symbol set, and a second symbol from a second symbol set different from said first symbol set; and constructing a portion of a tower of stacked layers of said game pieces, said constructing step comprising each said player selecting a game piece from at least said respective game portion and said tower portion below an uppermost one of said layers, and placing said selected game piece in said tower portion, such that one of said symbols of said selected game piece is identical to one of said symbols of a last played one of said game pieces.

2. The method according to claim 1, wherein said constructing step continues until one of said game portions is exhausted.

3. The method according to claim 1, wherein each said stacked layer comprises a predetermined maximum number of said game pieces, and during said constructing step, if said uppermost layer comprises said predetermined number, said selected game piece is placed on said uppermost layer.

4. The method according to claim 1, wherein during said constructing step, if one of said players selects said selected game piece from said tower and said tower collapses, said one player collects all of said game pieces comprising said collapsed tower.

5. The method according to claim 1, wherein each said game piece comprises an elongate game block including opposite ends and elongate faces extending between said ends, and said constructing step comprises placing said game pieces on said elongate faces substantially parallel to each other in each said layer.

6. The method according to claim 5, wherein said constructing step comprises placing said game pieces comprising one of said layers substantially perpendicular to said game pieces comprising an adjacent one of said layers.

7. The method according to claim 1, wherein said selecting step is derived from a card game involving discarding cards into a central pot and discarding cards from said players hands.

8. The method according to claim 7, wherein said card game is selected from the group of games comprising euchre, pinochle, rummy, crazy eights and crazy jacks.

* * * * *

UNITED STATES PATENT AND TRADEMARK OFFICE
CERTIFICATE OF CORRECTION

PATENT NO. : 6,022,026

DATED : Feb. 8, 2000

INVENTOR(S) : Walter J. Johnson, III

It is certified that error appears in the above-identified patent and that said Letters Patent is hereby corrected as shown below:

Col. 1, line 6, deleted "files and insert -- filed --;

Col. 2, line 15, delete "tie" and insert -- the --;

Col. 4, line 5, delete "nor" and insert -- not --.

Signed and Sealed this

Sixth Day of February, 2001

*Attest:*

Q. TODD DICKINSON

*Attesting Officer*

*Director of Patents and Trademarks*